US008004214B2

(12) United States Patent
Miyamoto

(10) Patent No.: US 8,004,214 B2
(45) Date of Patent: Aug. 23, 2011

(54) FLUORESCENT TUBE POWER SUPPLY AND BACKLIGHT

(75) Inventor: Hitoshi Miyamoto, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 386 days.

(21) Appl. No.: 12/184,929

(22) Filed: Aug. 1, 2008

(65) Prior Publication Data

US 2009/0033237 A1 Feb. 5, 2009

(30) Foreign Application Priority Data

Aug. 1, 2007 (JP) ..... 2007-201000

(51) Int. Cl.
*G05F 1/00* (2006.01)

(52) U.S. Cl. ..... 315/307; 315/247; 315/185 S; 315/274; 315/224

(58) Field of Classification Search ..... 315/247, 315/246, 224, 225, 209 R, 274–289, 291, 315/297, 307–311
See application file for complete search history.

(56) References Cited

U.S. PATENT DOCUMENTS 5,371,667 A * 12/1994 Nakao et al. ..... 363/124
5,422,548 A * 6/1995 Yamashita et al. ..... 315/308
5,663,613 A * 9/1997 Yamashita et al. ..... 315/308
5,744,916 A * 4/1998 Kawabata et al. ..... 315/308
7,557,523 B2 * 7/2009 Goriki et al. ..... 315/308
2003/0057871 A1 * 3/2003 Kominami et al. ..... 315/224
2007/0164689 A1 * 7/2007 Suzuki ..... 315/291
2007/0228996 A1 * 10/2007 Sugaya ..... 315/247

FOREIGN PATENT DOCUMENTS

JP 5-49252 2/1993
JP 2002-153075 5/2002
JP 2006-79997 3/2006

OTHER PUBLICATIONS

Patent Abstracts of Japan for Japanese Publication No. 2006-079997, Publication date Mar. 23, 2006 (1 page).
Patent Abstracts of Japan for Japanese Publication No. 2002-153075, Publication date May 24, 2002 (1 page).
Patent Abstracts of Japan for Japanese Publication No. 05-049252, Publication date Feb. 26, 1993 (1 page).

* cited by examiner

*Primary Examiner* — Tuyet Thi Vo
(74) *Attorney, Agent, or Firm* — Osha Liang LLP

(57) ABSTRACT

A fluorescent tube power supply including a rectification circuit, a smoothing circuit, an inverter, and a control circuit for controlling the inverter, further includes a current detecting unit for detecting an input current of the inverter. The control circuit is stopped based on an output signal of the current detecting unit when the input current increases.

2 Claims, 4 Drawing Sheets

FLUORESCENT TUBE POWER SUPPLY AND BACKLIGHT

BACKGROUND OF THE INVENTION

1. Field of the Invention

The present invention relates to a fluorescent tube power supply and a backlight.

2. Description of the Related Art

Voltage and current sometimes change on a demand side due to inconsistency between a supply side that generates power and transmits power, and the demand side on which great change in load occurs. Electrical products may not operate properly when such change occurs.

For instance, in a backlight used in a liquid crystal television, a converter, that is, a direct current (DC) power supply for converting an output of a domestic commercial power supply to a DC and an inverter for converting an output of the DC power supply to an alternating current (AC) are used as a power supply circuit. As the current or the power input to the inverter reduces, the brightness of a screen becomes less than the preset brightness. As the current or the power increases, the brightness of the screen becomes more than the preset brightness.

In particular, a discharge tube such as a Cold Cathode Fluorescent Lamp (CCFL) used in the backlight has negative resistance characteristics. That is, the current decreases as the voltage rises, and the current increases as the voltage lowers. Impedance of a fluorescent tube such as a CCFL differs depending on the current-carrying time, and also varies depending on each fluorescent tube. The luminance of the fluorescent tube and the backlight, on the other hand, depend on a tube current or a tube power of the fluorescent tube, and thus a stable current supply and power supply are required for the fluorescent tube.

The fluorescent tube employs PWM control to regulate illuminance level. A width of a pulse that controls ON/OFF of the fluorescent tube, that is, a duty ratio is changed by performing the PWM control. When the duty ratio is changed, light-on and light-off of the fluorescent tube are repeated at a speed unrecognizable by humans, so that illuminance level can be regulated.

On the other hand, if the current or the power input to the inverter changes, the current or the power of the fluorescent tube does not stabilize in the PWM control and a state where the duty ratio of the PWM control becomes large sometimes continues.

Under such situation, Japanese Laid-Open Patent Publication No. 2006-79997 proposes a lighting device of a fluorescent tube lamp which has a triangular wave oscillator for increasing or decreasing an operation frequency of a switching element and a comparator for converting the triangular wave output from the triangular wave oscillator to a rectangular wave of a predetermined duty ratio and outputting the same arranged in a drive circuit for driving the switching element that carries out the PWM control. According to such a circuit configuration, the power accumulated in a transformer is made substantially constant by fluctuating the operation frequency of the switching element while maintaining the duty ratio of the input power supply substantially constant, and so that the energy accumulated in the transformer during the ON operation of the switching element cancels out the voltage fluctuation of the input power supply.

Japanese Laid-Open Patent Publication No. 2002-153075 proposes a power supply device for controlling $V_{P-P}$ (difference in maximum peak voltage and minimum peak voltage) of an output waveform, a frequency, and a duty ratio by arranging a switching circuit for controlling a rise of a secondary side output of a transformer and a switching circuit for controlling a fall of the secondary side output of the transformer.

Japanese Laid-Open Patent Publication No. H05-49252 proposes an inverter for detecting a secondary side output of a transformer, generating data to set a duty ratio of a switching pulse by feeding back the detected secondary side output, comparing the generated data and the detected secondary side output, and changing the duty ratio based on the comparison result to have the secondary side output at an appropriate value.

SUMMARY OF THE INVENTION

The lighting device disclosed in Japanese Laid-Open Patent Publication No. 2006-79997 detects the voltage of the input power supply of the inverter, but does not detect the input current or the input power of the inverter.

Therefore, a case where the input voltage is constant and the input current of the inverter is increased, that is, a case where the impedance of the load such as the inverter and the fluorescent tube is small cannot be detected.

In addition, since the input power of the inverter is not detected, a case where the input voltage changes and a case where the input power changes cannot be distinguished. For instance, even if the input voltage does not change, the input current may change due to the negative resistance characteristics of the fluorescent tube, and the input power may change. Conversely, the input power may not change even if the input voltage lowers as the impedance lowers and the current increases. In particular, it is preferable that the input current or the input power of the inverter is detected since the luminance of the fluorescent tube depends on the tube current or the tube power.

Furthermore, the above lighting device intends to stabilize the duty ratio, while it is not a power supply to stop the inverter or lower the duty ratio of the PWM control when the current or the power increases.

In the power supply device disclosed in Japanese Laid-Open Patent Publication No. 2002-153075, a feedback control is performed to control the duty ratio. Therefore, the circuit configuration becomes complex as the output of the secondary side of the transformer needs to be detected to perform feedback. The upper limit of the duty ratio for preventing damage of the circuit is defined in a Machine Control Unit (MCU), and a hardware is not employed.

In the inverter described in Japanese Laid-Open Patent Publication No. H05-49252, the feedback control is also performed to control the duty ratio. Therefore, the circuit configuration becomes complex as the output of the secondary side of the transformer needs to be detected to perform feedback. The upper limit of the duty ratio for preventing damage of the circuit is defined in a CPU.

In view of such circumstances, the present invention aims to provide a fluorescent tube power supply in which increase in the duty ratio of the PWM control in the inverter can be restrained even if the current or the power input to the inverter is increased, and a backlight employing the fluorescent tube power supply.

In order to achieve the above aim, the present invention provides the following technical means.

A fluorescent tube power supply according to a first aspect of the present invention includes a rectification circuit supplied with an AC power supply; a smoothing circuit to which an output of the rectification circuit is input; an inverter to which an output of the smoothing circuit is input; and a control circuit for controlling the inverter; wherein the fluorescent tube power supply further includes a current detecting unit for detecting an input current of the inverter, and the control circuit is stopped based on an output signal of the current detecting unit when the input current increases.

According to such a fluorescent tube power supply, the AC power is supplied to the rectification circuit such as a diode bridge, and the rectified power is supplied to the smoothing circuit of such as capacitor input type. The power converted to a DC by rectification and smoothing is supplied to the inverter, and converted to a high frequency AC power which lights the fluorescent tube arranged on the output side of the inverter.

In this case, if the input current of the inverter is increased, the output signal of the current detecting unit is changed and input to the control circuit, thereby stopping the control circuit.

The term "stop" includes not only a case where the function of the control circuit is completely stopped and the function of the inverter is stopped when the power supply of the control circuit is shut off, but also a case where the control circuit turns to a standby mode and the duty ratio of the PWM control becomes 0%, the drive of the driver in the inverter is stopped, or the fluorescent tube current becomes zero.

Therefore, in the fluorescent tube power supply, if the current input to the inverter is increased, a signal for stopping the control circuit is provided from the current detecting unit, so that the increase in the duty ratio of the PWM control in the inverter is restrained.

A fluorescent tube power supply according to a second aspect of the present invention includes a rectification circuit supplied with an AC power supply; a smoothing circuit to which an output of the rectification circuit is input; an inverter to which an output of the smoothing circuit is input; and a control circuit for controlling the inverter; wherein the fluorescent tube power supply further comprises a current detecting unit for detecting an input current of the inverter, a voltage detecting unit for detecting an input voltage of the inverter, and a calculating unit for calculating an input power of the inverter based on an output signal of the current detecting unit and an output signal of the voltage detecting unit, and the control circuit is stopped based on an output signal of the calculating unit when the input power increases.

According to such a fluorescent tube power supply, the AC power is supplied to the rectification circuit such as a diode bridge, and the rectified power is supplied to the smoothing circuit of such as capacitor input type. The power converted to a DC by rectification and smoothing is supplied to the inverter, and converted to a high frequency AC power which lights the fluorescent tube arranged on the output side of the inverter.

In this case, the input power of the inverter is calculated in the calculating unit based on the input current and the input voltage of the inverter. When the input power of the inverter increases, a signal for stopping the control circuit is provided from the calculating unit, then the increase in the duty ratio of the PWM control is restrained.

In the fluorescent tube power supply according to the present invention, it is preferable that the output signal for stopping the control circuit is input to an enable terminal of the control circuit.

The enable terminal of the control circuit is provided to shift a mode of the control circuit from the normal mode to the standby mode. When the enable terminal becomes low level, an oscillator in the control circuit for performing control etc. of the inverter stops, and most part of the control circuit is shut down. Therefore, the increase in the duty ratio of the PWM control is restrained.

When the enable terminal becomes high level, the control circuit again returns to the normal mode, so that the PWM control can be performed, and a high frequency voltage is generated to light the fluorescent tube.

In the fluorescent tube power supply according to the present invention, the output signal may be input to a power supply terminal of the control circuit. The power supply of the control circuit is then shut off by the output signal, and the function of the control circuit is completely stopped. Thus, the increase in the duty ratio of the PWM control in the inverter is restrained.

When the power supply terminal becomes high level, the control circuit again returns to the normal mode, so that the PWM control can be performed, and a high frequency voltage is generated to light the fluorescent tube.

A backlight according to the present invention includes the above-described fluorescent tube power supply, and a fluorescent tube supplied with power from the fluorescent tube power supply.

Thus, even if current or power supplied to the inverter is increased, the increase in the duty ratio of the PWM control in the inverter used as the fluorescent tube power supply is restrained, thereby preventing the luminance of the backlight from becoming too high.

According to the present invention, a fluorescent tube power supply in which the increase in the duty ratio of the PWM control in the inverter is restrained even if current or power supplied to the inverter is increased, and a backlight employing the fluorescent tube power supply can be obtained.

DETAILED DESCRIPTION OF THE PREFERRED EMBODIMENTS

Embodiments of the present invention will be described with reference to the drawings.

Figure 1:
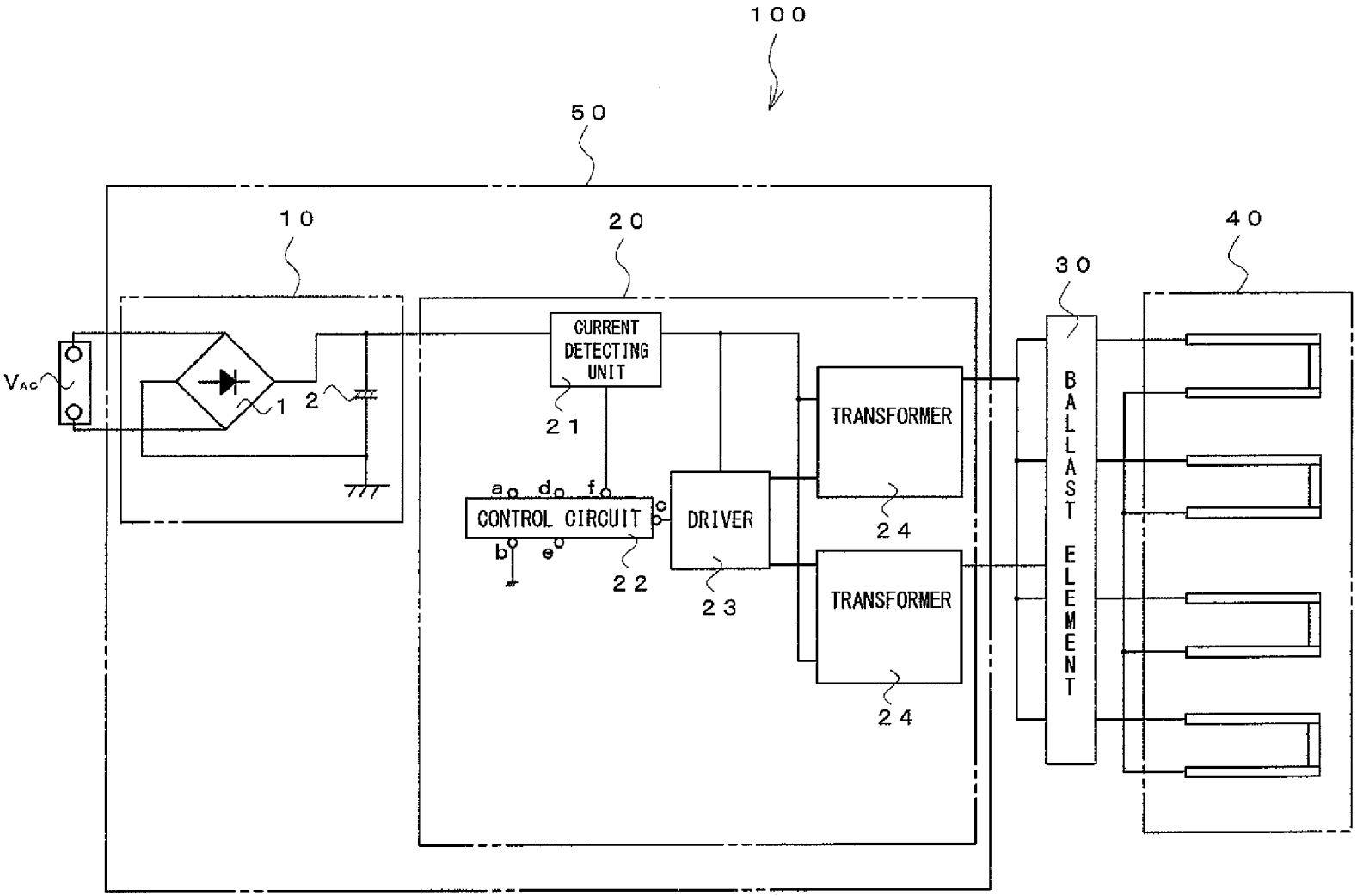
FIG. 1 is a circuit block diagram of a backlight according to a first embodiment of the present invention.

FIG. 1 is a circuit block diagram of a backlight for detecting input current of an inverter according to a first embodiment of the present invention.

As shown in FIG. 1, a backlight 100 includes a converter 10 supplied with a domestic commercial power supply, that is, an AC power supply $V_{AC}$ and converting an AC output from the AC power supply $V_{AC}$ to a DC, an inverter 20 for converting the DC output from the converter 10 to a high frequency AC, a ballast element 30 for stabilizing the current flowing in a fluorescent tube 40, and the fluorescent tube 40. The converter 10 and the inverter 20 form a fluorescent tube power supply 50.

The ballast element 30 is a ballast capacitor, and the fluorescent tube 40 is a CCFL. The domestic commercial power supply is a single-phase AC 100 V in Japan.

The converter 10 is a circuit that rectifies and smoothes the AC power supply $V_{AC}$, and converts the AC power to a DC power which is the input power supply of the inverter 20, and includes a rectification circuit 1 and a smoothing circuit 2.

The rectification circuit 1 is a diode bridge made up of four rectification diodes, and performs a full-wave rectification. The output waveform of the rectification circuit 1 is thus a full-wave rectified waveform, that is, a DC with large pulsation.

The DC with large pulsation, which is the output of the rectification circuit 1, is directly input to the smoothing circuit 2 to be converted to the DC in which the pulsation is reduced in the smoothing circuit 2. The smoothing circuit 2 is a capacitor input type, and an electrolytic capacitor is used. The smoothing circuit 2 is a low pass filter for passing only the frequency lower than the frequency of the AC power supply $V_{AC}$.

The inverter 20 supplied with the DC output of the converter 10 includes a current detecting unit 21 for detecting the output current of the converter 10, a control circuit 22 to which an output signal of the current detecting unit 21 is input, a driver 23 to which a gate drive signal from the control circuit 22 is input, and a transformer 24 controlled by the driver 23.

The current detecting unit 21 detects the input current of the inverter 20, and transmits an output signal of high level or low level to the control circuit 22 based on the input current. In current detection, a current detection resistor may be used to detect a voltage across the current detection resistor. The output signal is transmitted as a high level signal when the detected voltage is greater than or equal to a predetermined threshold value, and as a low level signal when the detected voltage is smaller than the predetermined threshold value.

Therefore, the output signal lowers from high level to low level when the input current of the inverter 20 increases.

The driver 23 includes a switching element. The switching element is alternately conducted based on the output signal of the control circuit 22, that is, the gate drive signal to excite the transformer 24. Thus, a high frequency voltage generates on the secondary side of the transformer 24. The fluorescent tube power supply 50 outputting the high frequency voltage lights the fluorescent tube 40 through the ballast element 30.

The control circuit 22 is arranged on the primary side of the transformer 24, and an IC is used therefor. A power supply terminal a, a GND terminal b, a gate drive terminal c, a PWM control terminal d, a lamp current control terminal e, and an enable terminal f are arranged for the terminals of the control circuit 22.

The DC power is supplied to the power supply terminal a, and the control circuit 22 operates when the power is supplied to the power supply terminal a. The GND terminal b is arranged in correspondence to the power supply terminal a.

The gate drive terminal c is connected to the gate of the switching element in the driver 23, and drives the gate and generates the high frequency voltage on the secondary side of the transformer 24 therethrough.

The PWM control terminal d is a terminal to which a signal for regulating an illuminance level of the fluorescent tube 40 is input. The frequency of the PWM signal, the minimum value of the duty ratio etc. can be changed with an external component such as the IC connected to the relevant terminal. The width of the pulse, that is, the duty ratio for controlling ON/OFF of the inverter 20 can be changed by the PWM control of the inverter 20. When the duty ratio is changed, light-on and light-off of the fluorescent tube 40 are repeated at a speed unrecognizable by humans. Therefore, the illuminance level of the fluorescent tube 40 can be regulated by using the PWM control terminal d.

The lamp current control terminal e is a terminal to which a signal for controlling the current of the fluorescent tube 40 is input. The current flowing to the fluorescent tube 40 can be detected and the relevant current can be controlled by detecting the voltage on the external component such as the IC connected to the relevant terminal.

The enable terminal f is provided to stop the control circuit 22 by shifting a mode of the control circuit 22 from a normal mode to a standby mode. When the enable terminal f becomes low level, the oscillation inside the control circuit 22 stops and most of the control circuit 22 is shut down. In the standby mode, the drive of the driver 23 may be stopped, the current of the fluorescent tube 40 may be shut down, and the duty ratio of the PWM control may be made to 0%.

When the enable terminal f becomes high level, the control circuit 22 again returns to the normal mode, so that the fluorescent tube 40 is lighted and the illuminance level can be regulated.

When the input current of the inverter 20 increases and becomes greater than or equal to a predetermined current value, that is, greater than or equal to a threshold value, the output signal of the current detecting unit 21 shifts from high level to low level. Therefore, the enable terminal f becomes low level when the output of the current detecting unit 21 is input to the enable terminal f of the control circuit 22. In other words, the current detecting unit 21 provides to the control circuit. 22 the output signal for causing the control circuit 22 to be in the standby mode, and thus a resonance of the inverter 20 and the current of the fluorescent tube 40 connected to the fluorescent tube power supply 50 are shut off, and the increase in the duty ratio of the inverter 20 is restrained.

Figure 2:
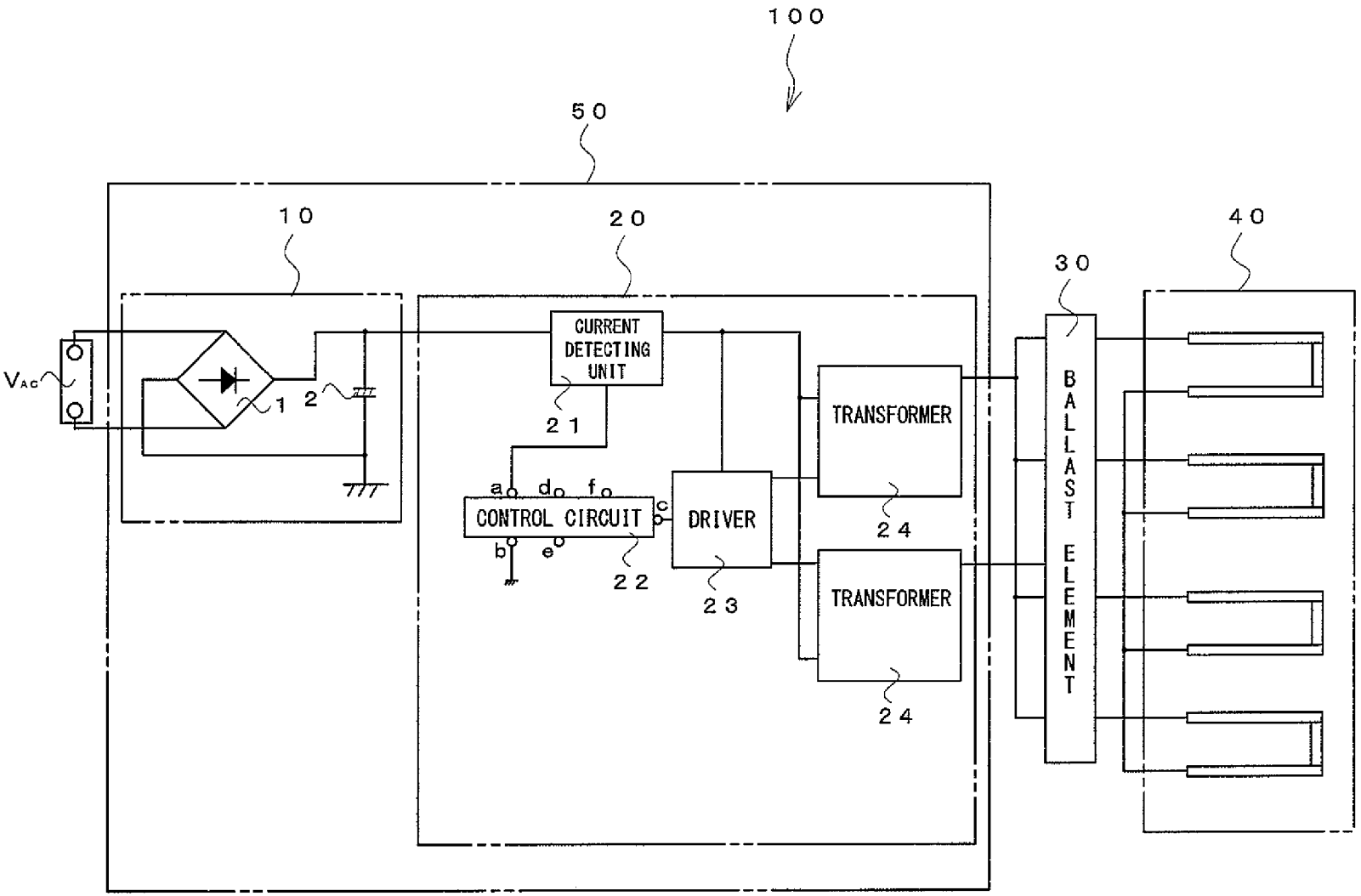
FIG. 2 is a circuit block diagram of a backlight according to a second embodiment of the present invention.

FIG. 2 is a circuit block diagram of a backlight according to a second embodiment of the present invention. In the present embodiment, the output signal of the current detecting unit 21 is input to the power supply terminal a of the control circuit 22.

In the second embodiment, when the input current of the inverter 20 becomes large and the output signal of the current detecting unit 21 becomes low level, the power supply of the control circuit 22 is shut off and the function of the control circuit 22 is completely stopped. Thus, the drive of the driver 23 is stopped or the duty ratio of the PWM control becomes 0%.

Thereafter, when the input current of the inverter 20 decreases and the power supply terminal a of the control circuit 22 becomes high level, the control circuit 22 again operates to drive the driver 23 and light the fluorescent tube 40, and performs the PWM control to change the duty ratio.

Therefore, although the output of the current detecting unit 21 is input to the power supply terminal a of the control circuit 22, the current detecting unit 21 provides to the control circuit 22 the output signal for stopping the control circuit 22, and thus the resonance of the inverter 20 and the current of the fluorescent tube 40 connected to the fluorescent tube power supply 50 are shut off, and the increase in the duty ratio of the inverter 20 is restrained.

Figure 3:
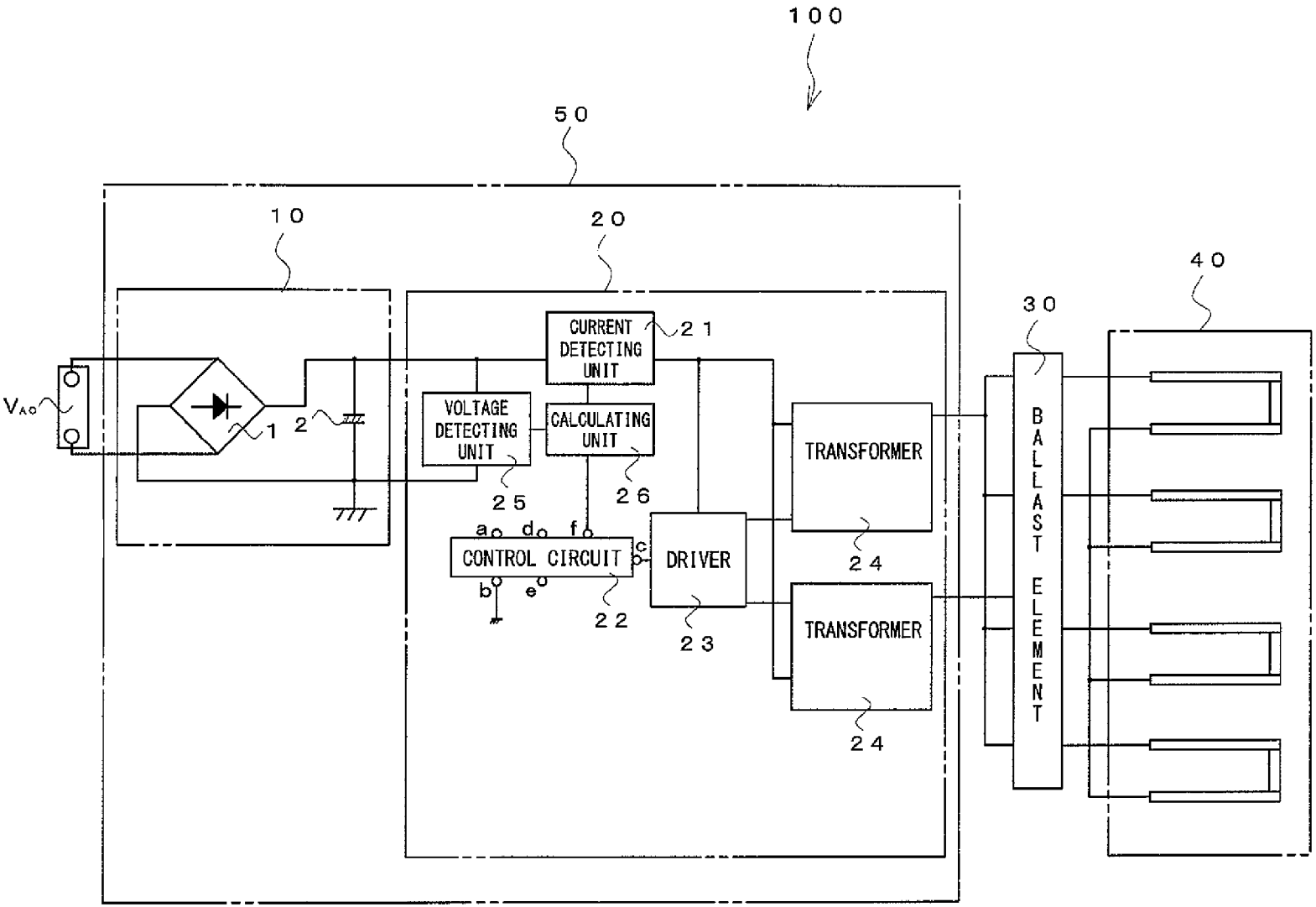
FIG. 3 is a circuit block diagram of a backlight according to a third embodiment of the present invention.

FIG. 3 is a circuit block diagram of a backlight for detecting an input power of the inverter according to a third embodiment of the present invention.

In the third embodiment shown in FIG. 3 as well, a backlight 100 includes a converter 10 for converting an AC output from an AC power supply $V_{AC}$ to a DC, an inverter 20 for converting the DC output from the converter 10 to a high frequency AC, a ballast element 30, and a fluorescent tube 40, similar to the first and the second embodiments. The converter 10 and the inverter 20 form a fluorescent tube power supply 50.

The converter 10 includes a rectification circuit 1 and a smoothing circuit 2. The inverter 20 to which the DC output of the converter 10 is input includes a current detecting unit 21 for detecting an input current of the inverter 20, a voltage detecting unit 25 for detecting an input voltage of the inverter 20, and a calculating unit 26 for calculating an input power of the inverter 20 based on the output signal of the current detecting unit 21 and the output signal of the voltage detecting unit 25.

The inverter 20 further includes a control circuit 22 to which an output signal of the calculating unit 26 is input, a driver 23 to which a gate drive signal of the control circuit 22 is input, and a transformer 24 controlled by the driver 23.

The driver 23 includes a switching element, and alternately conducts the switching element based on the gate drive signal to excite the transformer 24. Thus, a high frequency voltage generates on the secondary side of the transformer 24.

The control circuit 22 is arranged on the primary side of the transformer 24, and an IC is used therefor. A power supply terminal a, a GND terminal b, a gate drive terminal c, a PWM control terminal d, a lamp current control terminal e, and an enable terminal f are arranged for the terminals of the control circuit 22.

The current detecting unit 21 detects the input current of the inverter 20, and outputs the value of the input current to the calculating unit 26. The current detecting unit 21 in the third embodiment needs to be configured to output a current value. The current detection can be carried out, for example, by arranging a current detection resistor, and detecting a voltage across the current detection resistor.

The voltage detecting unit 25 detects the input voltage of the inverter 20, and outputs the value of the input voltage to the calculating unit 26. The voltage detecting unit 25 also needs to be configured to output a voltage value. The voltage detection can be carried out, for example, by using a plurality of voltage detection resistors to divide the input voltage of the inverter 20.

The calculating unit 26 includes an arithmetic circuit which can be configured with an multiplication circuit since the current value input from the current detecting unit 21 and the voltage value input from the voltage detecting unit 25 are DC value, respectively.

Furthermore, the calculating unit 26 outputs a low level signal when the power obtained in the multiplication circuit, that is, the input power of the inverter 20 becomes greater than or equal to a predetermined threshold value. The calculating unit 26 outputs a high level signal when the input power of the inverter 20 is smaller than the predetermined threshold value.

When the input power of the inverter 20 is greater than or equal to the predetermined threshold value, the output signal of the calculating unit 26 becomes low-level and the duty ratio of the PWM control may become 0%.

When the input power of the inverter 20 becomes smaller than the predetermined threshold value, the enable terminal f becomes high level, the control circuit 22 again returns to the normal mode, the fluorescent tube 40 is lighted, and the illuminance level can be regulated by the PWM control.

Figure 4:
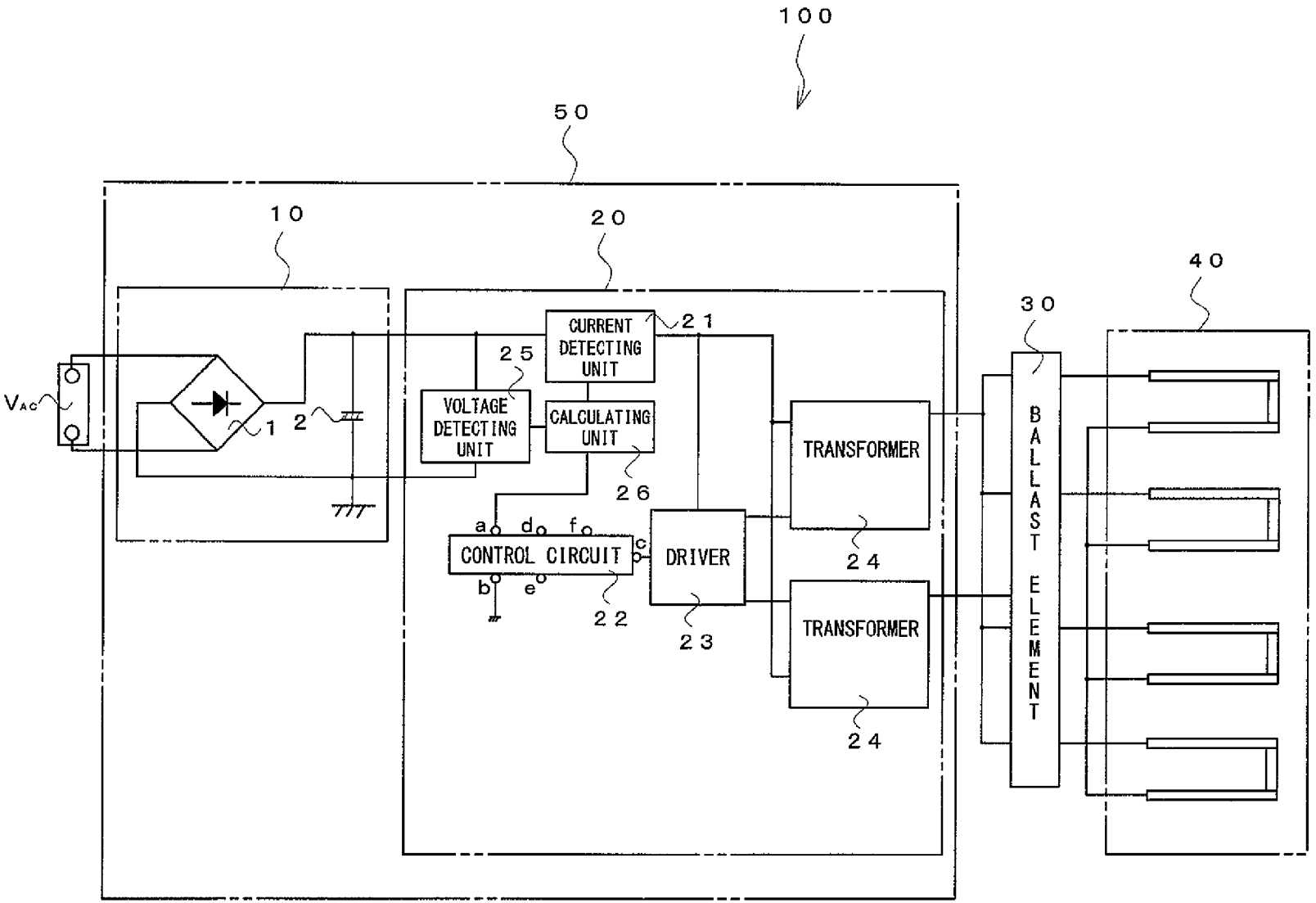
FIG. 4 is a circuit block diagram of a backlight according to a fourth embodiment of the present invention.

FIG. 4 is a circuit block diagram of a backlight according to a fourth embodiment of the present invention. In the present embodiment, an output signal of the calculating unit 26 is input to the power supply terminal a of the control circuit 22.

In the fourth embodiment, when the input power of the inverter 20 becomes large and the output signal of the calculating unit 26 becomes low level, the power supply of the control circuit 22 is shut off and the function of the control circuit 22 is completely stopped. Thus, the drive of the driver 23 is stopped or the duty ratio of the PWM control becomes 0%.

Thereafter, when the input power of the inverter 20 decreases and the power supply terminal a of the control circuit 22 becomes high level, the control circuit 22 again operates to drive the driver 23 and light the fluorescent tube 40, and performs the PWM control to change the duty ratio.

Therefore, although the output of the calculating unit 26 is input to-the power supply terminal a of the control circuit 22, the calculating unit 26 provides to the control circuit 22 the output signal for stopping the control circuit 22, and thus the resonance of the inverter 20 and the current of the fluorescent tube 40 connected to the fluorescent tube power supply 50 are shut off, and the increase in the duty ratio is restrained.

The present invention includes various embodiments other than the embodiments described above. The inverter 20 may be an inverter of any type such as self-excited oscillating type, half-bridge type or full-bridge type using power conversion element. The fluorescent tube 40 is also not limited to a CCFL. The functions of the control circuit 22, that is, the IC may differ from those described above. For instance, although the duty ratio of the inverter 20 lowers when the IC stops, the duty ratio does not need to be 0%. The current detecting unit 21, the voltage detecting unit 25, the calculating unit 26, the inverter 20 and the like used in the backlight 100 may have any circuit configuration or circuit element within the scope not departing from the concept of the present invention.

What is claimed is:

1. A fluorescent tube power supply comprising:

a rectification circuit configured to be supplied with an alternating current (AC) power supply;

a smoothing circuit configured to receive an output of the rectification circuit;

an inverter configured to receive an output of the smoothing circuit;

a control circuit configured to control the inverter; and a current detecting unit configured to detect an input current of the inverter, wherein the control circuit is stopped based on an output signal of the current detecting unit when the input current increases, the control circuit is an integrated circuit comprising an enable terminal and a power supply terminal, the control circuit is shifted from a normal mode to a standby mode when the output signal of the current detecting unit is input to the enable terminal, and power supply of the control circuit is shut off and function of the control circuit is completely stopped when the output signal of the current detecting unit is input to the power supply terminal.

2. A backlight comprising the fluorescent tube power supply according to claim 1, and a fluorescent tube supplied with power from the fluorescent tube power supply.

* * * * *